US007735458B2

(12) United States Patent
Stapensea

(10) Patent No.: US 7,735,458 B2
(45) Date of Patent: Jun. 15, 2010

(54) DEVICE FOR DISPENSING A HEATED FLUID AND HEATING DEVICE THEREFOR

(75) Inventor: Jan Aede Stapensea, Norg (NL)

(73) Assignee: Hamilton Engineering, Inc., Livonia, MI (US)

( * ) Notice: Subject to any disclaimer, the term of this patent is extended or adjusted under 35 U.S.C. 154(b) by 1002 days.

(21) Appl. No.: 11/405,896

(22) Filed: Apr. 18, 2006

(65) Prior Publication Data

US 2007/0040042 A1 Feb. 22, 2007

(30) Foreign Application Priority Data

Aug. 3, 2005 (NL) ..... 1029676

(51) Int. Cl.
*F24H 1/18* (2006.01)

(52) U.S. Cl. ..... 122/20 R; 122/36; 237/19

(58) Field of Classification Search ..... 122/20 R, 122/36, 18.5, 20 B, 421, 20 A, 14.3; 237/19
See application file for complete search history.

(56) References Cited

U.S. PATENT DOCUMENTS 1,563,532 A * 12/1925 Shadrick ..... 122/14.22
1,727,015 A * 9/1929 McClurg ..... 122/14.31
2,291,023 A * 7/1942 Burklin ..... 122/14.31
2,906,258 A * 9/1959 Parker ..... 122/250 R
3,007,470 A * 11/1961 Heeger ..... 122/14.22
4,178,907 A * 12/1979 Sweat, Jr. ..... 261/39.1
4,417,546 A * 11/1983 Hoskinson ..... 122/20 B
5,020,721 A * 6/1991 Horne ..... 236/20 R
6,131,536 A * 10/2000 Kujawa ..... 122/14.22
6,938,581 B2 * 9/2005 Neeser et al. ..... 122/20 R
7,195,176 B2 * 3/2007 Newman ..... 236/20 R

* cited by examiner

*Primary Examiner*—Gregory A Wilson
(74) *Attorney, Agent, or Firm*—Howard & Howard Attorneys PLLC

(57) ABSTRACT

The invention relates to a device and method for dispensing a heated fluid and an external heating device. The device comprises a supply of fluid, a discharge connected to the supply for drawing off heated fluid, a feed for cold fluid connected to the supply, and the heating device. The heating device for heating fluid comprises a suction conduit connected to the supply and provided with a pump means, a heat exchanger with heat source arranged downstream of the suction conduit, a pressure conduit for heated fluid debouching in the supply, at least one temperature detecting means for measuring the temperature of fluid, and a control coupled to the temperature detecting means for controlling the pump means and/or heat source. The invention is characterized in that an outlet of the feed and an inlet of the suction conduit are arranged in the vicinity of each other in the supply. The invention is also characterized in that the temperature detecting means is coupled upstream of the heat exchanger to the suction conduit.

14 Claims, 1 Drawing Sheet

DEVICE FOR DISPENSING A HEATED FLUID AND HEATING DEVICE THEREFOR

CROSS-REFERENCE TO RELATED APPLICATIONS

The subject patent application claims priority to and all the benefits of Netherlands Patent Application No. 1029676, which was filed on Aug. 3, 2005, with the Netherlands Patent Center.

BACKGROUND OF THE INVENTION (1) Field of the Invention

The invention relates to a device for dispensing a heated fluid, comprising a supply of fluid, a discharge connected to the supply for drawing off heated fluid from the supply, a feed for cold fluid connected to the supply, and a heating device for heating the fluid. The invention also relates to a heating device for heating the fluid, comprising a suction conduit provided with a pump means, a heat exchanger with heat source arranged downstream of the suction conduit, a pressure conduit for heated fluid coupled to the heat exchanger, at least one temperature detecting means for measuring the temperature of the fluid and a control coupled to the temperature detecting means for controlling the pump means and/or heat source.

(2) Description of Related Art

It is known to heat tap water in various ways. It is known to have a supply of tap water, wherein the tap water is heated directly by means of a separate exchanger with its own heat sources. This is connected to a supply tank. It is known to suction fluid out of the supply, usually from a low point in the supply, and to transport this to the heat exchanger. The pressure conduit carries the fluid back into the supply, often also at a low point. Owing to thermal action the hot water will hereby rise upward from the bottom until the whole supply has the desired temperature. The external heating is switched on when a control device determines by temperature measurement that the temperature of the heated fluid in the supply is too low. The temperature detecting means can be placed in the supply, or is for instance placed downstream of the heat exchanger.

For the purpose of increasing the effectiveness of the heat exchanger it has been proposed in the past to connect the feed for cold fluid directly onto the suction conduit of the heating device. The cold water is hereby heated directly and the heat exchanger is used effectively. This does however create problems in respect of the difference in water pressure. Such a system is also very dependent on the flow resistance in the external exchanger.

SUMMARY OF THE INVENTION

An object of the invention is to provide a device wherein use is made of temperature measurement outside the supply, a highly effective use of the efficiency of the heat exchanger, and wherein the problems in respect of the water pressure are obviated.

The object is achieved according to the invention in that an outlet of the feed and an inlet of the suction conduit are arranged in the vicinity of each other in the supply. When cold fluid is introduced via the feed into the supply, a part of the cold fluid will hereby be able to enter the inlet of the suction conduit, whereby it will be located in the external heat exchanger. The feed of cold water can hereby be detected at a distance, i.e. in the suction conduit, and the control device can control the external heat exchanger such that it will begin to heat. The measurement of the temperature in the supply or a measurement of the feed can hereby be separated from control of the external heat exchanger. According to the invention "in the vicinity" means that fluid inflow from the feed will partially enter the inlet of the suction conduit, and that the inlet and outlet are not far removed, for instance less than 20 mm, from each other.

It is advantageous that the feed for cold fluid in the suction line are coupled by means of the exchange portion received in the supply. Via the exchange portion cold fluid can enter the supply and fluid can be drawn out of the supply by the external heat exchanger.

The temperature detecting means is preferably coupled upstream of the heat exchanger to the suction conduit. The temperature of the fluid is hereby measured prior to the heat exchanger. The temperature of the fluid in the suction conduit is influenced by the dynamic pressure when cold fluid is fed to the supply via the feed conduit and can be measured with the temperature detecting means. A fall in the temperature below a pre-determined threshold results in the heat source for the heat exchanger being set into operation in the control. The pump will also draw fluid out of the supply and cause it to flow through the heat exchanger.

It is further advantageous according to the invention to substantially align the outlet and the inlet with each other or to place them mutually in line. The outflow from the outlet is thereby directed toward the inlet of the suction conduit. A temperature drop due to cold feed can hereby be detected more rapidly.

The exchange portion is preferably formed by the outlet of the feed received in the inlet of the suction conduit. Cold fluid that is fed will hereby enter the suction conduit. When the feed is more than the capacity of the pump means, the excess will be able to enter the supply via the opening between outlet and inlet. When the feed is less than the suction capacity of the heating device, additional fluid will be drawn out of the supply via the opening between outlet and inlet.

The inlet preferably has a tube end provided with a mouth and a number of openings arranged in the suction conduit close to the tube end. Fluid can be drawn into or flow out of the suction conduit through these openings, for instance when the feed is opened and the pump means of the heating device is not yet pumping.

The outlet of the feed preferably protrudes into the mouth. The tube-in-tube construction is hereby obtained.

According to a further preferred embodiment, the total surface area of the opening in the exchange portion of the suction conduit toward the supply is smaller than or equal to twice the area of the mouth of the outlet. The resistance of the suction conduit is hereby unchanged compared to the situation according to the prior art, and it is possible to operate with known pump means whose capacity does not have to be increased.

The outlet and inlet are preferably arranged close to an underside of the supply. A thermal effect is hereby obtained when hot fluid is fed back to the supply which is then mixed with the fluid in the supply in that the hot fluid will want to flow upward.

The control is preferably adapted to switch on the pump means repeatedly during a determined period of time. Per unit of time, for instance three hours, depending on the cooling speed of the supply, i.e. the insulating value, the pump is started for a short time (for instance one minute-depending on the water volume of the suction conduit and the rate at which the pump displaces the water) after a cooling by a number of degrees, for instance 5° C. The natural cooling (standstill losses) of the supply is hereby compensated. Through suction from the underside of the supply the lowest temperature of the fluid in the supply is measured by the temperature detecting means in the external heating device.

The water is drawn in via for instance the openings in the exchange portion close to the inlet of the suction conduit.

According to a further preferred embodiment, a second temperature detecting means is arranged downstream of the heat exchanger, and the second temperature detecting means is connected to the control. The temperature of the heated fluid can hereby be measured. This can be an additional safety measure. Too high a temperature of the fluid by heating can be the consequence of contamination in the heat exchanger, for instance limescale, and detection thereof must result in switch-off of the heat source.

According to a further embodiment, the control is adapted to derive from the measured temperature a gradient (temperature change in time) which is compared to a threshold value stored in a memory of the control. When the temperature gradient of the temperature measured by the second temperature detecting means is greater than a predetermined value, it is possible to derive herefrom that the heat exchanger is contaminated and must therefore be switched off. Too high a value is the consequence of for instance a narrowing of a channel in the heat exchanger. The throughflow is then too low and the fluid is heated too much. In another embodiment the gradient of the temperature measured at the first temperature detecting means is compared to a threshold value and, when the fall in the temperature is greater than a determined threshold value, the heating device is switched on. A fall greater than a determined threshold value is the consequence of feed of cold fluid to the supply. At the moment of cold feed it is advantageous to set the heating device into operation.

The invention also relates to a heating device for heating a fluid, comprising a suction conduit for cold fluid connectable to a supply and provided with a pump means, a heat exchanger with heat source arranged downstream of the suction conduit, a pressure conduit for heated fluid arranged downstream of the heat exchanger, a temperature detecting means for measuring the temperature of the fluid, and a control device coupled to the temperature detecting means for controlling the pump means and/or heat source. The device is characterized in that the detecting means is coupled upstream of the heat exchanger to the suction conduit. The temperature of indrawn water is hereby measured. This temperature is also influenced by fluid being fed to the supply to which the suction conduit is connected. The use of a temperature detecting means in the supply is hereby no longer necessary. The heating device can operate on its own and does not have to be coupled to other temperature detecting means.

The invention also relates to a heating device for heating a fluid, comprising a suction conduit for cold fluid connectable to a supply and provided with a pump means, a heat exchanger with heat source arranged downstream of the suction conduit, a pressure conduit for heated fluid coupled to the heat exchanger, at least one temperature detecting means for measuring the temperature of the fluid and a control coupled to the temperature detecting means for controlling the pump means and/or heat source. The invention is characterized in that the control device is adapted to derive a gradient for the temperature change from the temperature detected at the temperature detecting means, and to compare the gradient to a threshold value stored in a memory. A heating device is hereby obtained in which an improved temperature detection results in increased certainty. When a temperature detecting means is placed downstream of the heat exchanger, too great a temperature gradient can indicate that the heat exchanger is faulty, for instance due to limescale in the conduit.

The invention also relates to a method for controlling the heating of a fluid, comprising of controlling the heating and/or the suctioning of a cold fluid, discharging the heated fluid and measuring the temperature of the heated fluid, characterized in that the method further comprises of deriving a gradient of the measured temperature from the measured temperatures, comparing the gradient to the predetermined threshold and modifying the control when the gradient exceeds the threshold. An increased safety is hereby obtained, for instance against limescale on the heating element.

BRIEF DESCRIPTION OF THE DRAWINGS

The invention is not limited to the above stated combination of measures. All measures given in the description can each represent an invention per se and result in a divisional application. The invention will be further described with reference to the accompanying figures, in which.

DETAILED DESCRIPTION OF THE INVENTION

Figure 1:
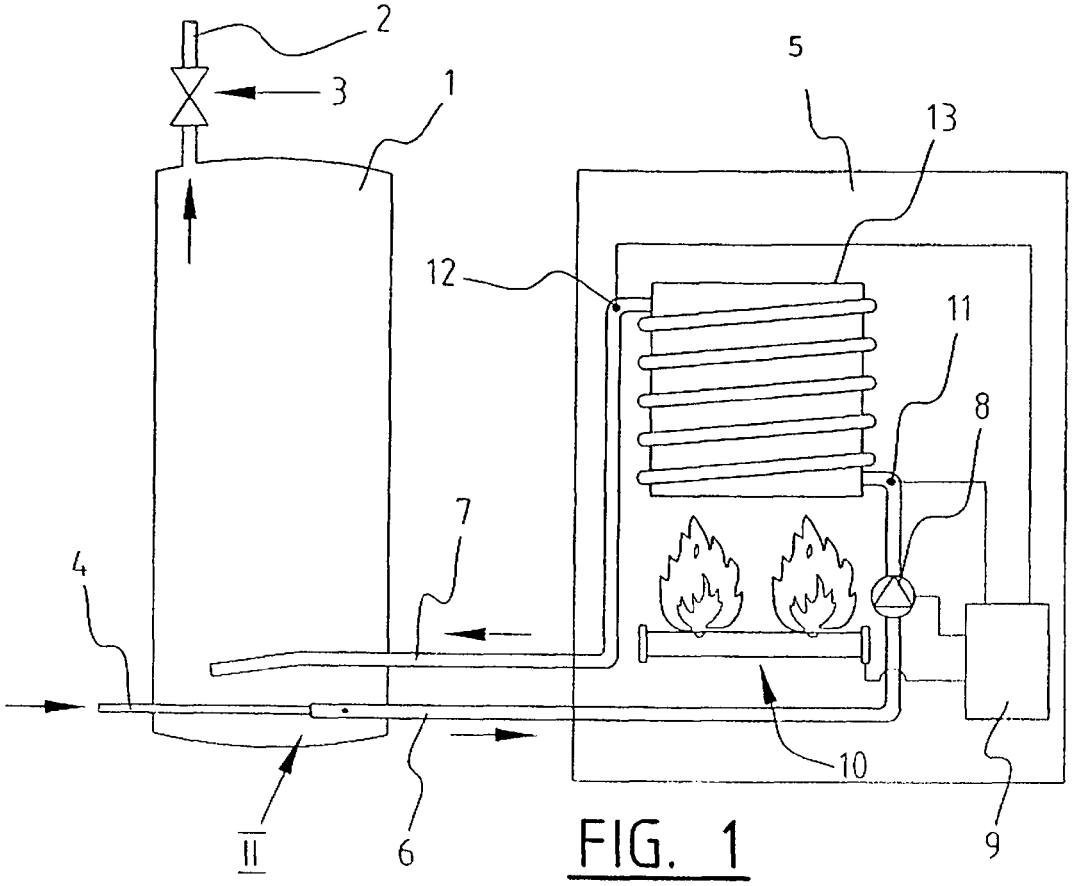
FIG. 1 shows a schematic view of a first embodiment of the invention.

FIG. 1 shows a supply container 1 in which a fluid such as water is received. Such supply containers are known from the prior art. The container can be provided with an appropriate insulation. Reference is made to known literature for details relating to the insulation. The supply container is suitable for receiving a heated fluid and storing thereof for a long time with little heat loss.

Fluid such as water is drawn off from the supply via a tap 2 provided with a controllable valve 3. It is advantageous to arrange the tap on the top of the supply as shown, since owing to the known thermal effect the hot water will accumulate at the top of the supply.

When fluid is drawn off, the quantity in the supply will decrease. A per se known circuit detects that water is being drained or measures a fall in the water level. Upon such a detection a control (not shown) of the supply will set into operation a feed for cold fluid 4, whereby the former level can be restored. The temperature in the supply will however decrease as a result of the feed.

An external heating device 5 is coupled to the supply for the purpose of heating the fluid, wherein suction conduit 6 and pressure conduit 7 of the heating device are connected to the supply and protrude into the supply space. Fluid can be carried into the heating device via these conduits and there heated as described below.

By placing the suction conduit in a low position or at the bottom of the supply the colder part of the fluid in the supply is drawn to heating device 5. The efficiency of heating is hereby increased, since the efficiency of an exchanger is directly dependent on the ratio of the indrawn water temperature and the combustion air temperature.

Pressure conduit 7 feeds heated fluid back into the supply. The mouth on the tube end of the pressure conduit is also situated at the bottom or in a low position in supply 1. The heated fluid will be carried into the bottom of the supply. Due to thermal effects the hotter fluid will rise and flows are hereby created in the supply container.

Heating device 5 will now be further described. Fluid can enter heating device 5 via the suction conduit. It is drawn into the heating device, for instance by means of a known pump means 8. The pump means is useful for, among other things, overcoming the flow resistance.

In a particular embodiment the heating device can be embodied without pump means, and use is made of the force of gravity. A valve is then present instead of the pump means.

Valve or pump means is controllable. Pump means 8 is connected to a control device 9 which is only shown schematically. The control device has a number of memory means and comparing means and a decision-making unit. The control has inputs and outputs which can be connected to detecting means or controllable means such as the pump and heat source 10. The control is provided with an interface unit so that a user can store a value in the respective memories and the comparing means can be programmed. A number of comparisons will be discussed below.

The control is further connected to a schematically shown temperature sensor 11 and 12. Detecting means 11 and 12 measure a temperature value of the fluid present in the respective conduits. First sensor 11 is situated upstream of heat exchanger 13, while second sensor 12 is arranged downstream. The sensors measure respectively the entry and exit temperature.

First temperature detecting means 11 can also be arranged in conduit 6 upstream of pump means 8.

The temperature detecting means are situated in the heating device. In contrast to the prior art, no temperature measuring means is arranged in the supply or it is not connected to control 9 of the external heating device 5. Control 9 operates without direct temperature measurement in container 1.

A first routine which can be performed by control 9 is described here. The heating device is switched on per fixed or variable unit of time, for instance three hours, depending on the cooling speed of supply 1, i.e. the insulating value. Switch-on signifies here at least starting the pump means 8. Heat source 10 can also be activated. In a particular embodiment heat source 10 is activated only when the temperature detected at sensor 11 is below a determined threshold value. Fluid will hereby be drawn in via the suction conduit and pass through heat exchanger 13 through the respective conduits. The heated fluid leaves heating device 5 via pressure conduit 7 and is fed back to supply 1.

The unit of time can be adjusted. With sensor 11 the control will detect what temperature the indrawn fluid has. When this is too low, the unit of time can be modified, in this case reduced. An acceptable reduction is for instance 5° C.

In this first routine the fluid is drawn in and heated for a predetermined or variable period of time. The period of time can also end with a detection by sensor 11 that the temperature of the indrawn fluid is sufficient. Further heating is then not necessary. A good mixing is obtained in the supply due to the favourable placing of the feed, suction and pressure conduits.

Further variables for the period of time for heating in the first routine can be the capacity of the pump, magnitude of the content of the suction conduit, and so on.

Figure 2:
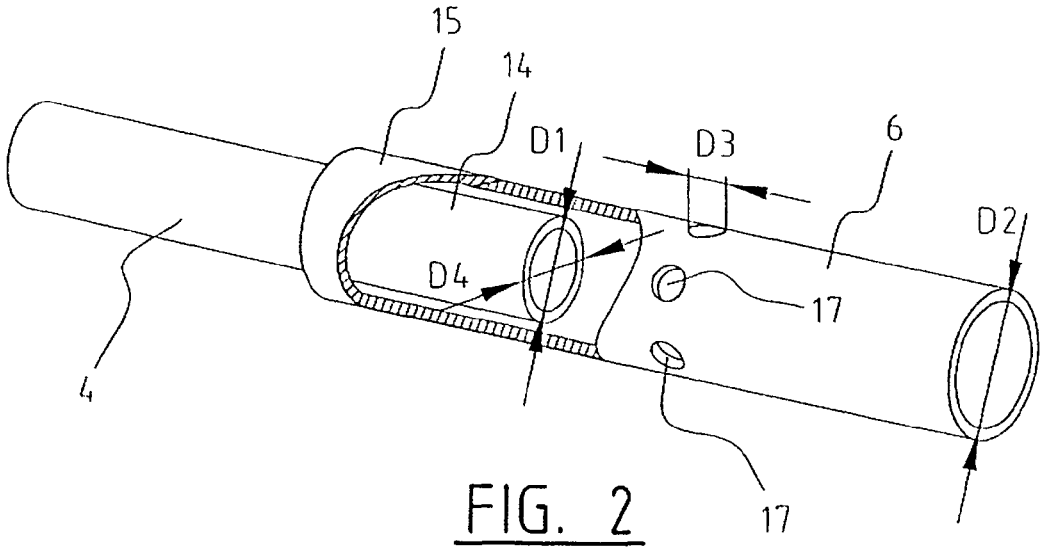
FIG. 2 shows a partially cut-away view of the detail according to arrow II in FIG. 1.

FIG. 2 will now be described. The detail is shown as according to arrow II, wherein the tube ends of feed 4 and the suction conduit 6 are more clearly visible. The tube end 14 of feed 4 of substantially circular cross-section is received in mouth 15 of suction conduit 6. Mouth 14 and feed 4 both have a diameter D1. The inner diameter D2 of the likewise circular suction conduit is greater than the outer diameter D4 of feed 4.

Tube end 14 protrudes for instance 5 cm into the suction conduit.

The suction conduit is also provided with a number of substantially circuar recesses 17, with an inner diameter D3. Recesses 17 are arranged at a distance from mouth 15 of the suction conduit and in the shown embodiment they are situated downstream of mouth 14 of the feed.

When fluid is supplied via the feed, the fluid can enter the supply by exiting between the inner diameter of suction tube D2 and outer diameter D4, or via openings 17. The area of the passages to the supply are substantially the same as the inner area of the feed (D1). In the shown embodiment the outflow resistance is thus no different than in the case of a known supply. It is particularly the case that:

$$(D2^2-D4^2)+D3^2>=D1^2,$$

or approximately $$D2^2+D3^2>=2D1^2.$$

The fact that tube ends 14 and 15 are arranged close to each other, in particular are directed at each other and in the preferred embodiment as shown are even partially received in each other, increases the efficiency.

The alignment and placing into each other can be seen as an exchange portion, wherein openings are formed between the tube ends which serve for both the feed and the suction. There will be an exchange portion according to the invention each time the throughflow areas between feed and suction conduit are smaller than 8×, preferably 5× the area of the suction conduit or the feed conduit, whichever is larger. Each time there is a fall below this limit there will be a direct influencing of the suction flow by the feed flow.

When the external heating device 5 is switched on, fluid will be drawn in from the supply via the same openings as above. The same openings serve both as feed for cold fluid and for suction of fluid out of the supply.

When the heating device is switched on while feed 4 is opened, at least a part of the cold feed will be carried directly to the heating device. The cold feed is the fluid in the supply with the lowest temperature, and the efficiency of the heating device is therefore maximized hereby.

When the capacity of heating device 5 is less than the amount of the feed, a part of the feed will enter the supply via said openings. When the capacity is sufficient, particularly a part of the fluid will be drawn out of supply 1 in addition to the greater part of the cold feed and heated therewith.

The throughflow of the external heat source (heating device) does not depend on the cold water inlet quantity; only on the pump capacity. The pump capacity is determined by the desired difference in temperature between suction temperature and the discharge temperature of the external heating device, and is not influenced by the tap water quantity.

Heating is stopped when the temperature at sensor 11 is sufficient. This does after all indicate that the temperature in supply 1 is sufficient.

When heating device 5 is switched off, the continued operation of the pump is a favourable measure. Use can hereby be made of the latent heat present in the heat exchanger. In one embodiment the heat source is first switched off, and then the pump. In a particular embodiment the pump is switched off only when the temperature at sensor 12 is the same as the temperature at sensor 11.

Control 9 also has a second routine. Owing to the dynamic pressure exerted by fluid fed to the supply, at least a part of the cold fed fluid will displace fluid in the suction conduit, even when the pump is not switched on, and will reach sensor 11. The sensor detects a fall in the temperature. The control can switch on the heating device in the case of such a change.

Despite the pump not operating, fluid will displace through the external heating device. The time depends on the takeoff rate (the magnitude of the dynamic force). The response time can be determined via the correct dimensioning of the openings, for instance at 10 L/min about 30 seconds and at 3 L/min after about two minutes.

The temperature detected by sensor 11 can be compared to a predetermined threshold temperature, preferably a defined setting point taking hysteresis into account. The heating device is switched on at a temperature lower than the determined threshold temperature.

In a particular embodiment the gradient [EC/sec] of the detected temperature is calculated by the control. The heating can be switched on at a determined minimum takeoff per unit of time. Owing to the cold feed the temperature will suddenly drop more quickly than due to insulation losses.

The control device adapted to calculate a gradient for the detected temperature and to compare the gradient with a threshold value stored in a memory means and the corresponding method can be the subject-matter of a divisional application.

In a further preferred embodiment the control is also adapted to calculate the gradient of the second temperature detected by sensor 12. When the gradient lies above a determined threshold value, which indicates a very rapid increase in the temperature, for example just after the heating device has been switched on, this may be an indication of blockage in one of the conduits of the heating device, whereby the throughflow speed is reduced. The fluid is being heated too much in the exchanger. This can result in damage. When such a detection is made the heating source is switched off. The blockage may be the consequence of limescale. In a particular embodiment the control generates a signal via the user interface that an engineer is required.

The invention claimed is:

1. A device for dispensing a heated fluid, said device comprising:

a supply of fluid, a discharge connected to the supply for drawing off heated fluid from the supply, a feed for cold fluid connected to the supply, and a heating device for heating the fluid, comprising:

a suction conduit connected to the supply and provided with a pump means, a heat exchanger with heat source arranged downstream of the suction conduit, a pressure conduit for heated fluid debouching in the supply, at least one temperature detecting means for measuring the temperature of the fluid, and a control coupled to the temperature detecting means for controlling at least one of the pump means and heat source, characterized in that an outlet of the feed and an inlet of the suction conduit are arranged in the vicinity of each other in the supply.

2. A device as claimed in claim 1, characterized in that the temperature detecting means is coupled upstream of the heat exchanger to the suction conduit.

3. A device as claimed in claim 1, characterized in that the outlet and inlet are substantially aligned with each other.

4. A device as claimed in claim 3, characterized in that a second temperature detecting means is arranged downstream of the heat exchanger, and that the second temperature detecting means is connected to the control.

5. A device as claimed in claim 1, characterized in that the feed for cold fluid and the suction conduit are coupled by an exchange portion received in the supply.

6. A device as claimed in claim 5, characterized in that the exchange portion is formed by the outlet of the feed received in the inlet of the suction conduit.

7. A device as claimed in claim 5, characterized in that the inlet comprises a tube end provided with a mouth and a number of openings arranged in the suction conduit close to the tube end.

8. A device as claimed in claim 7, characterized in that the outlet protrudes into the mouth.

9. A device as claimed in claim 5, characterized in that a total surface area of the openings and the inlet is smaller than or equal to twice the area of a mouth of the outlet.

10. A device as claimed in claim 1, characterized in that the outlet and the inlet are arranged on an underside of the supply.

11. A device as claimed in claim 1, characterized in that the control is adapted to switch on the pump means repeatedly during a determined period of time.

12. A heating device for heating a fluid, said heating device comprising:

a suction conduit for cold fluid connectable to a supply and provided with a pump means, a heat exchanger with heat source arranged downstream of the suction conduit, a pressure conduit for heated fluid arranged downstream of the heat exchanger, a temperature detecting means for measuring the temperature of the fluid, and a control device coupled to the temperature detecting means for controlling at least one of the pump means and heat source, characterized in that the temperature detecting means is coupled upstream of the heat exchanger to the suction conduit.

13. A heating device for heating a fluid, said heating device comprising:

a suction conduit for cold fluid connectable to a supply and provided with a pump means, a heat exchanger with heat source arranged downstream of the suction conduit, a pressure conduit for heated fluid arranged downstream of the heat exchanger, a temperature detecting means arranged downstream of the heat exchanger for measuring the temperature of the fluid, and a control coupled to the temperature detecting means for controlling at least one of the pump means and heat source, characterized in that the control is adapted to derive a gradient of the detected temperature and to compare the gradient to a predetermined threshold.

14. A method for controlling the heating of a fluid, said method comprising the steps of:

controlling at least one of the heating and the suctioning of a cold fluid, discharging the heated fluid and measuring the temperature of the heated fluid, characterized in that the method further comprises the steps of deriving a gradient of the measured temperature from the measured temperatures, comparing the gradient to a predetermined threshold and modifying the control when the gradient exceeds the threshold.

* * * * *